United States Patent [19]

Wallace

[11] 4,290,523

[45] Sep. 22, 1981

[54] COIN HOLDER

[75] Inventor: James J. Wallace, Milpitas, Calif.

[73] Assignee: Vacumet Finishing Inc., St. Clair, Mich.

[21] Appl. No.: 133,271

[22] Filed: Mar. 24, 1980

[51] Int. Cl.[3] ..... B65D 8/04; A45C 11/00; B65D 25/54

[52] U.S. Cl. ..... 206/0.82; 220/339; 206/459; 206/45.31

[58] Field of Search ..... 206/0.82, 459, 45.31; 220/339

[56] References Cited

U.S. PATENT DOCUMENTS

| | | | |
|---|---|---|---|
| 1,010,346 | 11/1911 | Burn | 206/0.82 |
| 4,139,093 | 2/1979 | Holmes | 206/0.82 |
| 4,183,432 | 1/1980 | Lemaire | 206/0.82 |

*Primary Examiner*—William T. Dixson, Jr.
*Attorney, Agent, or Firm*—Robert G. Mentag

[57] ABSTRACT

A coin holder having an elongated, cylindrical body which is formed of two integrally molded half-body portions, with each half-body portion having a semi-circular cross section. The semi-circular half-body portions are hingedly connected together along one adjacent edge of each half-body portion by a longitudinal living hinge. One of the half-body portions has a plurality of longitudinally disposed, staggered geometric openings, and an increment gauge so that every coin retained in the coin holder is visible and may be counted. The other half-body portion is provided with a closed wall, on the outer side of which may be carried messages of various types. The two half-body portions are releasably secured together by a latch and lip fastening structure.

11 Claims, 16 Drawing Figures

COIN HOLDER

BACKGROUND OF THE INVENTION

1. Field of the Invention

This invention relates to the coin holder art, and more particularly to a novel and improved coin holder which may also be used for holding tokens, and the like. The invention is specifically concerned with a coin holder of a permanent character which is particularly adapted for use by banks and other business concerns which handle large amounts of coins.

2. Description of the Prior Art

It is well known in the coin holder art to employ coin holders comprising two body members which are hinged together and which have releasable fastening means for holding the two body members in a closed position. A disadvantage of the prior art coin holders is that they are constructed so that all of the coins are not clearly visible, whereby slugs or other disc-like objects could be inserted without being observed unless the coin holder is opened. A further disadvantage of some of the prior art coin holders is the complicated fastening means employed to hold the two body members together. Examples of such prior art coin holders are illustrated in U.S. Pat. Nos. 1,145,743, 1,010,346, 3,402,806 and 4,139,093, and German Pat. No. 1 141 175 dated Jan. 26, 1962. Further examples of unitary coin holders are illustrated in U.S. Pat. Nos. 734,806, 3,606,008, 4,095,608 and French Pat. No. 1,429,170.

SUMMARY OF THE INVENTION

In accordance with the present invention, the coin holder comprises an elongated body which is cylindrical in over-all configuration, and which is formed from two half-body portions that each has a semi-circular cross section. The semi-circular half-body portions are hingedly connected together along one adjacent edge of each half-body portion by a continuous, integral, longitudinal living hinge to enable the half-body portions to be swung to an open position to allow access to the interior of the coin holder body for inserting or removing coins therefrom. One of the half body portions has a plurality of longitudinally disposed, staggered geometric openings, so that every coin retained in the coin holder is clearly visible to allow full inspection of the same. An increment gauge is provided on the half-body portion which has the staggered, geometric openings so that the user may quickly see how many coins are enclosed in the holder at any time. The other half-body portion is provided with a continuous closed wall, on the outer side of which may be carried messages of various types. The closed half-body portion is provided with a pair of intergral flanges or feet for retaining the coin holder in position on a flat surface. The two-half body portions are releasably secured together by a releasable latch and lip fastening means. One of the half-body portions is provided with at least one flange having a key-chain hole formed therethrough for attaching the coin holder to another item by a key-chain.

The coin holder may be made from any suitable material, as for example, a molded polypropylene material. The coin holder may be color coded for pennies, nickels, dimes and quarters. Each of the coin holder half-body portions is provided with end walls which do not extend over the endmost coins held in the coin holder, so that all of the coins in the coin holder are visible. The coin holder of the present invention may be used over and over again, as compared to a paper or plastic film coin holder which can be used once or twice only.

The coin holder of the present invention provides a fool-proof visible package which gives protection against slugs and shortages. It cuts labor costs for banks and bank customers. It reduces counting and coin wrapping time. It also aids in circulation of major coin denominations, and motivates customers to deposit coins which would otherwise stay in the homes of the customers.

Other features and advantages of this invention will be apparent from the following detailed description, appended claims, and the accompanying drawings.

DESCRIPTION OF THE PREFERRED EMBODIMENTS

Figure 1:
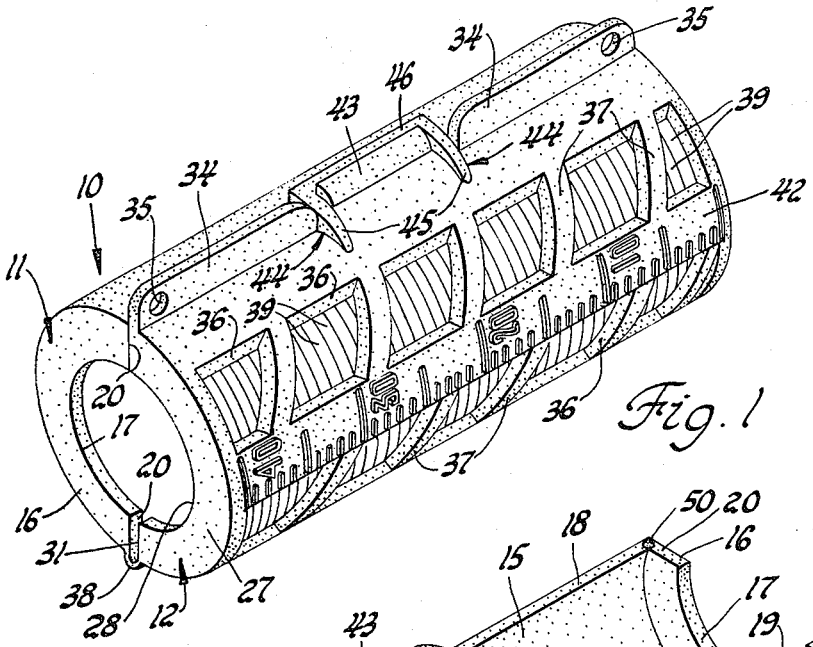
FIG. 1 is an elevational perspective view of a closed coin holder made in accordance with the principles of the present invention and showing the holder containing coins.
Figure 2:
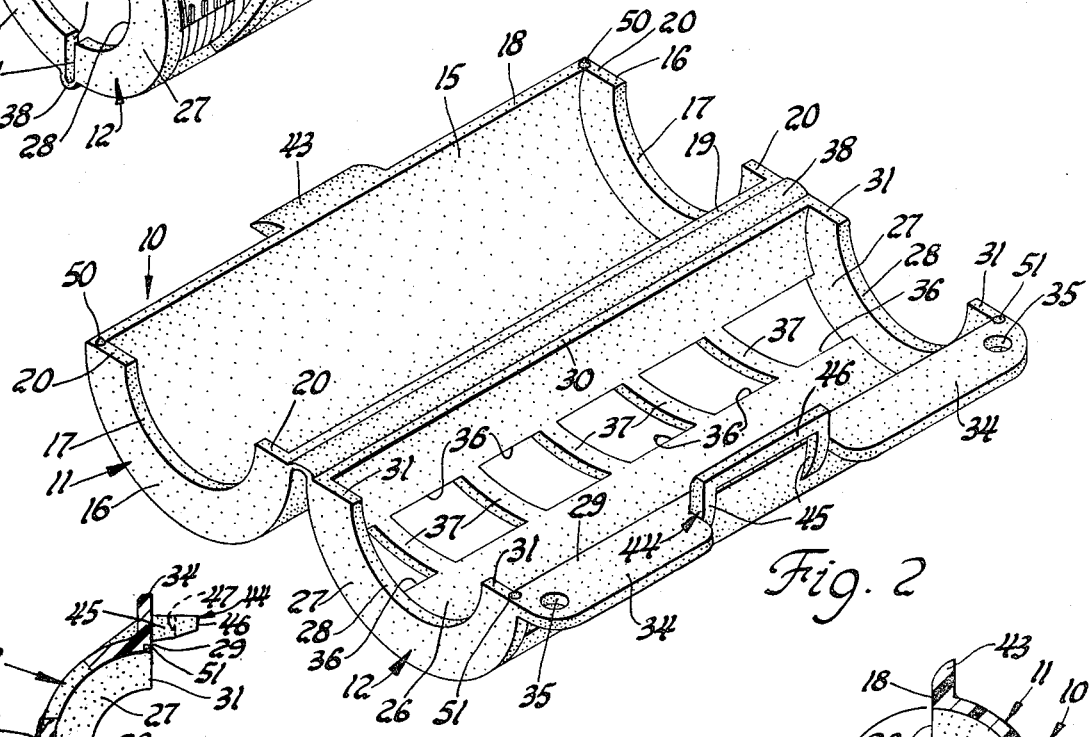
FIG. 2 is a perspective open view of the coin holder of FIG. 1, with the coins removed.
Figure 5:
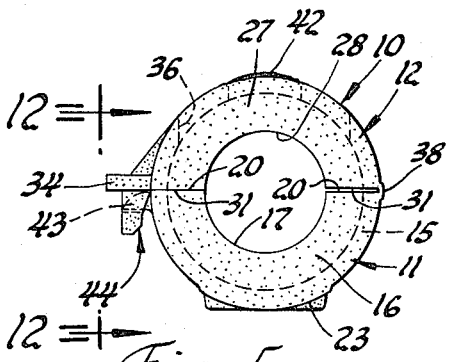
FIG. 5 is a left side elevation view of the closed coin holder illustrated in FIG. 1, and with the holder turned 90° from the position shown in FIG. 1.
Figure 4:
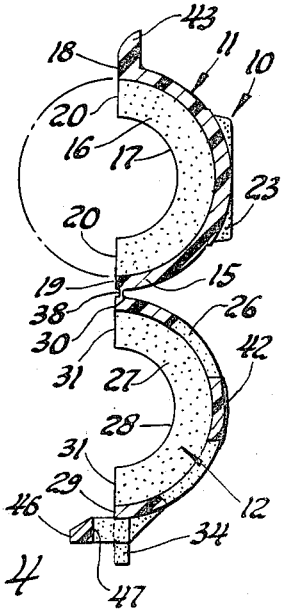
FIG. 4 is a transverse section view of the coin holder structure illustrated in FIG. 9, taken along the line 4—4 thereof, and looking in the direction of the arrows.

Referring now to the drawings, and in particular to FIGS. 1 and 2, the numeral 10 generally designates a coin holder made in accordance with the principles of the present invention. The coin holder 10 comprises an elongated body, which is cylindrical in over-all configuration, and which is formed from two half-body portions, each having a semi-circular cross section. The semi-circular half-body portions are generally indicated by the numerals 11 and 12. FIG. 5 shows the coin holder 10 in an upright standing position which it assumes when it is disposed on a level surface, and it will be seen that the lower body half-portion is the one marked with the numeral 11, and the upper half-body portion is the one generally indicated by the numeral 12.

Figure 3:
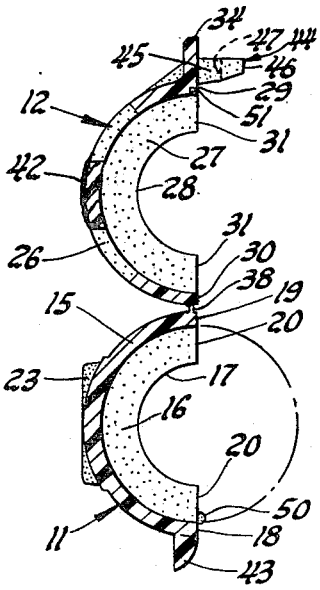
FIG. 3 is a transverse section view of the coin holder structure illustrated in FIG. 6, taken along the line 3—3 thereof, and looking in the direction of the arrows.
Figure 9:
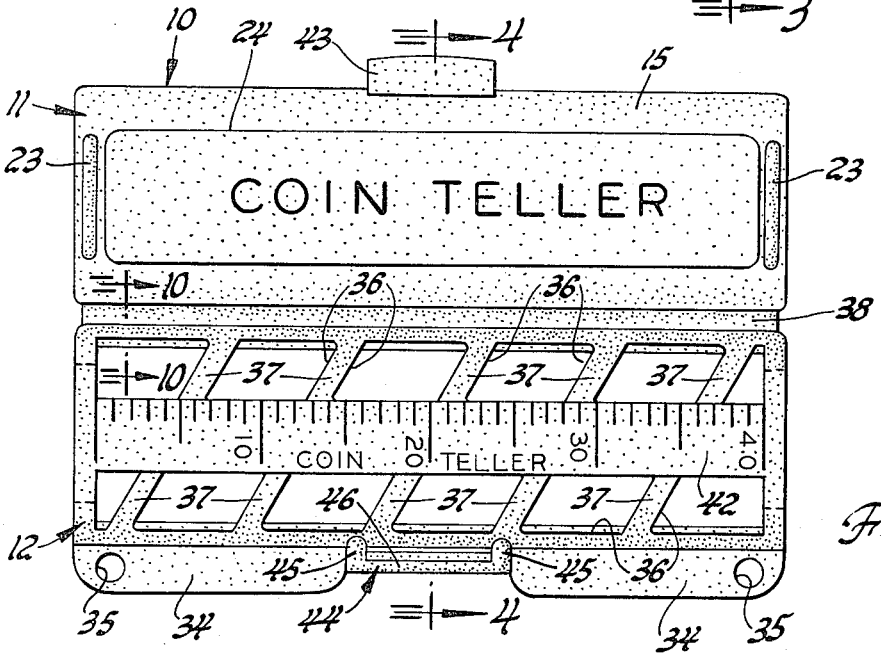
FIG. 9 is an open plan view of the coin holder illustrated in FIG. 1, and showing the outer side thereof.
Figure 10:
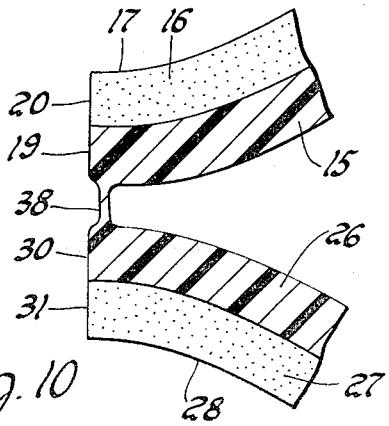
FIG. 10 is a fragmentary, enlarged, elevational section view of the coin holder illustrated in FIG. 9, taken along the line 10—10 thereof, and looking in the direction of the arrows.
Figure 11:
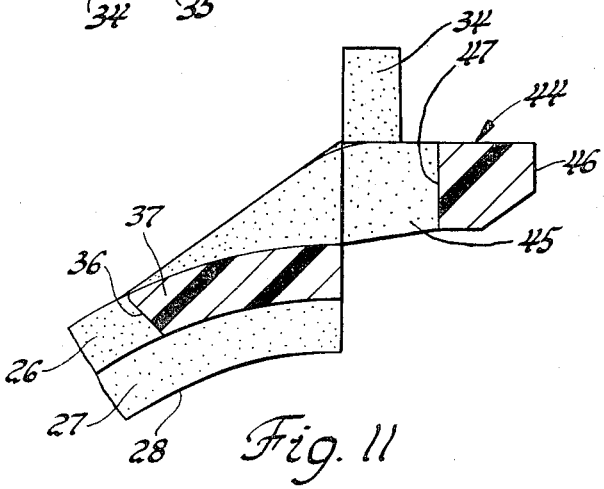
FIG. 11 is a fragmentary, enlarged view of the upper end of the coin holder shown in FIG. 3, and showing the latch structure in a blown-up size.

As best seen in FIG. 2, the coin holder lower half-body portion 11 comprises an elongated portion having a semi-circular, continuous and closed outer wall 15 which is partially enclosed at its ends by integral semi-circular end walls 16. Each of the end walls 16 has a semi-circular recess 17 formed therethrough. The inner and outer edges of the half-body wall 15 are indicated by the numerals 18 and 19, and they are formed flat and coplanar. The half-body portion wall edges 18 and 19 are also coplanar with the upper ends or edges 20 of the end walls 16, as shown in FIG. 2. As shown in FIGS. 3, 5 and 9, the lower half-body portion 11 is provided with a pair of longitudinally spaced apart, integral flanges 23 which function as feet or rest members for maintaining the coin holder 10 in the position shown in FIG. 5 when it is disposed on a flat surface. As shown in FIG. 9, the outer face of the lower half-body portion 11 is provided with an ad-message area on which may be molded the name of a bank or other business organization employing the coin holder 10. A suitable trademark for the coin holder 10 may also be shown on the ad-message area 24, as for example the trademark "COIN TELLER," as shown in FIG. 9.

Figure 6:
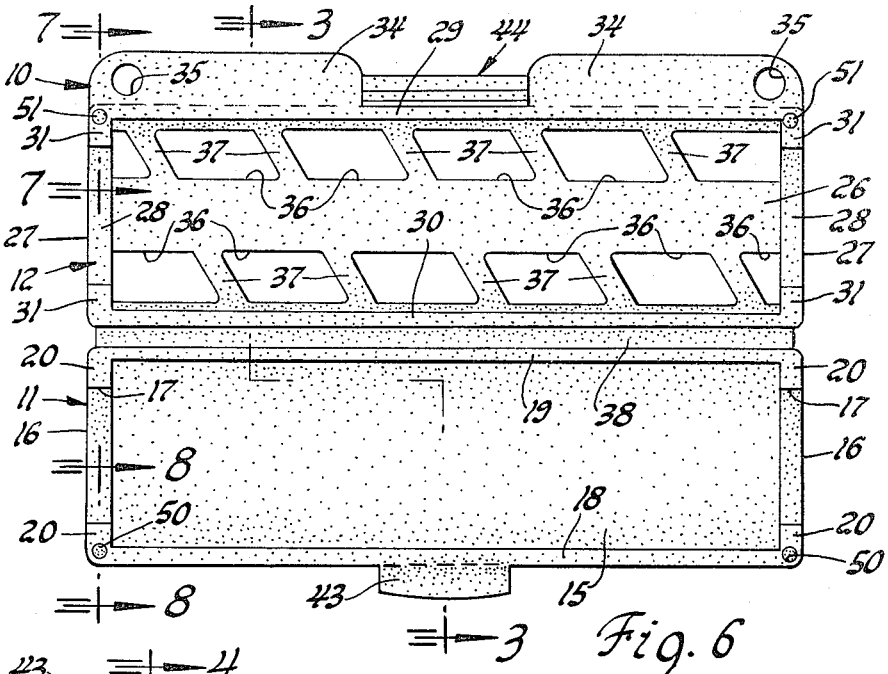
FIG. 6 is an open plan view of the coin holder illustrated in FIG. 1, and showing the inside of the holder with the coins removed.

As shown in FIGS. 2 and 6, the coin holder upper half-body portion 12 comprises an elongated portion having a semi-circular outer wall 26 which is enclosed at its ends by integral semi-circular end walls 27. Each of the end walls 27 has a semi-circular recess 28 formed therethrough. The inner and outer edges of the half-body wall 26 are indicated by the numerals 29 and 30, and they are formed flat and coplanar. The half-body portion wall edges 29 and 30 are also coplanar with the upper ends or edges 31 of the end walls 27, as shown in FIG. 2.

As shown in FIGS. 1 and 2, the upper half-body portion 12 is provided with a pair of aligned, outwardly extended radial flanges 34 which are integral with the body wall edge 29. Each of the flanges 34 is provided with a suitable keyhole 35 through which may be mounted a suitable key chain for attaching an identification tag, an extra car key, or the like, to the coin holder 10 for emergency purposes.

As shown in FIGS. 6 and 9, the upper half-body portion 12 is provided with at least two rows of staggered openings 36 which are divided by spacer walls 37. It will be seen that the openings 36 in one row are staggered relative to the openings 36 in the other row. The openings 36 are shown in the first embodiment of FIGS. 1 through 12 as being formed in the shape of a trapazoid, with two horizontal edges and two vertical angular but parallel edges. The geometrically arranged openings 36 are disposed so as to allow full inspection of the coins 39 (FIG. 1). It is possible to see at a glance if there are any irregularities in the contents of the coin holder 10.

As shown in FIGS. 1 through 6, the two half-body portions 11 and 12 are integrally connected along one adjacent edge thereof by a living hinge 38 which is made of the same material as employed in molding the half-bodies 11 and 12. The coin holder half-bodies 11 and 12, and the hinge 38 may be molded in one piece, from any suitable material, such as a polypropylene plastic material.

As shown in FIGS. 1 and 9, the upper half-body portion 12 is provided with a coin increment gage 42 which has a coin scale molded thereon in accordance with the size of coin holder, so that the user can quickly look at the coin scale and quickly see how many coins are enclosed in the coin holder 10 at any time.

As shown in FIGS. 1 through 6, the coin holder 10 is provided with a releasable fastening means which includes a latch lip 43 that is integrally attached to the lower half body portion 11, and a U-shaped latch member, generally indicated by the numeral 44, that is integrally formed on the upper half-body portion 12. As seen in FIGS. 1 and 6, the latch lip 43 extends outward radially and it is integrally formed on the outer side of the lower half-body wall 15, adjacent the outer edge 19. The upper side of the latch lip 43 curves downwardly (FIG. 13) to meet the flat lower side of said lip. The latch lip 43 is centrally located relative to the longitudinal length of the lower half-body portion 11.

Figure 13:
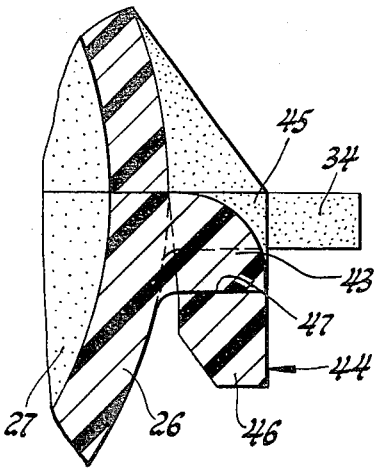
FIG. 13 is a fragmentary, enlarged, elevational section view of the coin holder structure illustrated in FIG. 12, taken along the line 13—13 thereof, and looking in the direction of the arrows.
Figure 12:
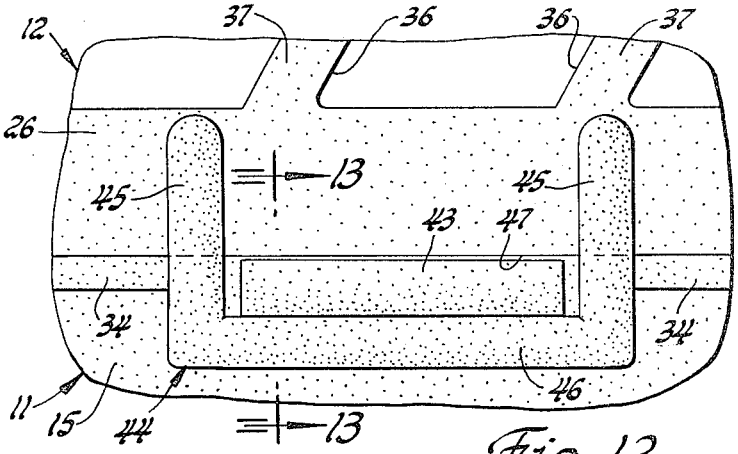
FIG. 12 is a fragmentary, front elevational view of the coin holder structure illustrated in FIG. 5, taken along the line 12—12 thereof, and looking in the direction of the arrows.

As shown in FIGS. 1, 2, 6 and 9, the latch 44 is also centrally located relative to the longitudinal length of the upper half-body portion 12, in a position between the inner ends of the flanges 34. As best seen in FIGS. 1 and 2, the latch 44 includes two spaced apart, transverse, integral side arms 45 which are integrally formed on the outer side of the upper half-body portion wall 26 and extend tangentially outward therefrom and toward the lower half-body portion 11 when the coin holder 10 is in the closed position, as shown in FIGS. 1 and 5. The outer ends of the transverse latch arms 45 are connected by a longitudinally extended, integral latch arm 46 which functions with the latch arms to form the U-shaped latch 44. As shown in FIGS. 1, 5 and 13, when the upper half-body portion 12 is swung over the lower half-body portion 11, the latch lip 43 moves into the space 47 formed between the latch longitudinal arm 46 and the upper edge 29 on the upper half-body portion 12, and it snaps into that space 47 in a position with the lower flat face releasably seated on the inner side of the latch longitudinal arm 46. The structure of the upper half-body portion 20 is such that it permits a slight outward bending or flexing of the latch 44 when the two half-body portions 11 and 12 are moved together to permit the latch lip 43 to slide under the latch longitudinal arm 46 and thence into position within the space 47 of said latch 44.

Figure 7:
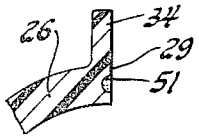
FIG. 7 is a fragmentary, elevational section view of the coin holder structure illustrated in FIG. 6, taken along the line 7—7 thereof, and looking in the direction of the arrows.
Figure 8:
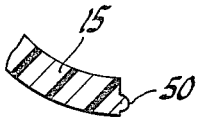
FIG. 8 is a fragmentary, elevational section view of the coin holder structure illustrated in FIG. 6, taken along the line 8—8 thereof, and looking in the direction of the arrows.

As shown in FIGS. 6, 7 and 8, the upper half-body portion 12 is provided at each of the outer ends of the front edge 29 thereof with a semi-circular recess 51, which receives a mating semi-circular projection 50 that is integrally formed at each of the ends of the front edge 18 of the lower half-body portion 11, when the coin holder is in the closed position shown in FIGS. 1 and 5. The projections 50 coact with the recesses 51 to provide stability to the coin holder 10 when it is in said closed position, and to assist in preventing the snap fastening latch 44 from accidentally disengaging from the latch lip 43 due to transverse distortion of the two half-body portions 11 and 12.

In use, assuming that the coin holder 10 is in the closed position shown in FIGS. 1 and 5, it may be quickly and easily opened by pressing inwardly on the lower half-body portion 11 in a position below the latch 43, then pushing upwardly on the latch 44, to release it from the latch lip 43. The living hinge 38 assists in the springing-open action of the upper half-body portion 12 when the latch 44 is released from the latch lip 43.

After the coins 39 have been loaded into the coin holder 10, it will be seen that the end walls 16 and 27 of the two half-body portions 11 and 12, respectively, retain the coins 39 in the coin holder 10 without covering the outer periphery of the endmost coins 39, so that none of the coins 39 are hidden from view. After the coin holder 10 is loaded with coins 39, it may be quickly and easily closed by swinging the upper half-body portion 12 downwardly, whereby the latch member 44 will flex outwardly and snap over the latch lip 43 and into a locking or fastening position therearound. It will be understood that the coin holder 10 may be completely filled with coins 39, or it may be partially filled with coins 39 at one time, and additional coins 39 added at a later time.

Figure 15:
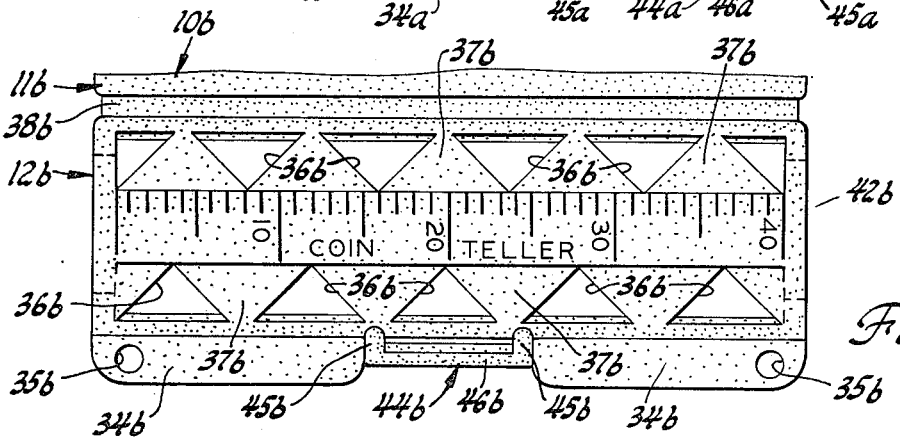
Figure 16:
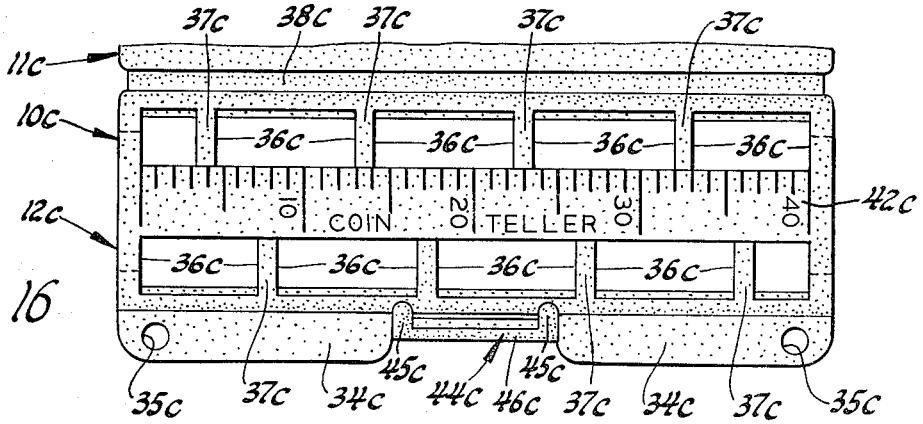

FIGS. 13, 15 and 16 illustrate three modified embodiments of the invention, and the parts which are the same as the corresponding parts of the embodiment of FIGS. 1 through 13 have been marked with the same reference numerals followed by the small letters "a", "b" and "c", respectively.

Figure 14:
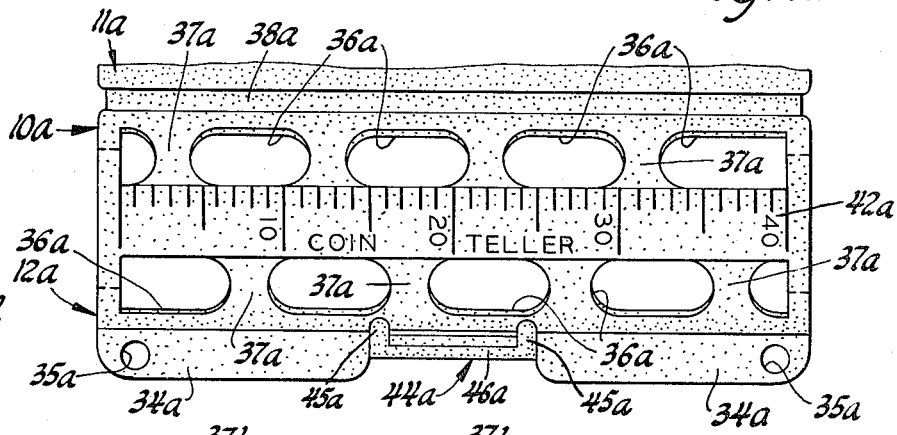
FIGS. 14, 15 and 16 are fragmentary, elevation views of three modified embodiments of the invention.

In the embodiment of FIG. 14, the geometric openings 36*a* are shown as two rows of oblong openings having parallel sides and rounded ends. The openings 36*a* in one row are staggered or offset relative to the openings 36*a* in the other row. The openings 36*a* in each row are longitudinally aligned.

The geometric openings 36*b* in the embodiment of FIG. 15 are shown as being formed in the shape of a triangle. Two rows of the triangular openings 36*b* are employed. The openings 36*b* in each row are aligned with each other. The opening 36*b* in one row are offset from the openings 36*b* in the other row.

The geometric openings 36*c* in the embodiment of FIG. 16 are also formed in two rows. The openings 36*c* are rectangularly formed. The openings 36*c* in one row are offset or staggered relative to the openings 36*c* in the other row. The openings 36*c* in each row are aligned.

The openings 36*a*, 36*b* and 36*c* in the embodiment of FIGS. 14, 15 and 16, respectively, permit a quick and accurate viewing of the coins inside of the respective coin holders 10*a*, 10*b* and 10*c* in the same manner as the openings 36 shown in the first embodiment of FIGS. 1 through 13. The two rows of openings 36*a*, 36*b* and 36*c* are disposed on opposite sides of the coin charts 42*a*, 42*b* and 42*c*, respectively.

While it will be apparent that the preferred embodiments of the invention herein disclosed are well calculated to achieve the results aforestated, it will be appreciated that the invention is susceptible to modification, variation and change.

What is claimed is:

1. A molded, polymeric, integral one-piece construction holder for coins, comprising:

(a) an elongated hollow cylindrical body having an internal circular cross-section of a diameter substantially that of a certain size coin to the retained in the holder, and which body includes two half-body portions, each having a semi-circular cross section;

(b) a continuous, elongated, integral living hinge member hingedly joining said half-body portions along an adjacent edge of each of said half-body portions;

(c) each of said half-body portions being provided with a longitudinal free edge and an integral partial end wall;

(d) one of the half-body portiona being formed with a plurality of geometric openings, which are disposed so that the outer periphery of each coin in the holder is visible, and which are disposed in at least two longitudinal rows, and with the geometric openings in one row being longitudinally offset from the geometric openings in the other row; and, (e) integral fastener means for releasably locking the two half-body portions in a closed position including an inverted U-shaped latch member on the outer side of one of said half-body portions and extending tangentially from the longitudinal free edge thereof over the other of said half-body portions, and a lip fastener member on the other of said half-body portions and extended outward radially from the longitudinal free edge on said other half-body portion for releasable locking engagement with the latch member when the two half-body portions are swung to a closed position.

2. A molded, integral holder for coins as defined in claim 1, including:

(a) an integral coin chart disposed between said two longitudinal rows of geometric openings.

3. A molded, integral holder for coins as defined in claim 2, wherein:

(a) the half-body portion having said plurality of geometric openings comprises an upper half-body portion, and the other half-body portion comprises a lower half-body portion which is provided with means for maintaining the holder in position on a flat surface, and preventing it from rolling on said surface.

4. A molded, integral holder for coins as defined in claim 3 wherein:

(a) said means for maintaining the holder in position comprises a pair of longitudinally spaced apart, integral transverse flanges.

5. A molded, integral holder for coins as defined in claim 3, wherein:

(a) said lower half-body portion is provided with a continuous, closed outer wall surface.

6. A molded, integral holder for coins as defined in claim 5, wherein:

(a) one of said half-body portions is provided with at least one outwardly extended flange which has an opening formed therethrough for the reception of a retainer chain.

7. A molded, integral holder for coins as defined in claim 5, wherein:

(a) one of said half-body portions is provided with a pair of recesses and the other of said half-body portion is provided with a pair of mating projections for seating in said pair of recesses when the holder is in a closed position, for retaining the half-body portions against transverse movement relative to each other.

8. A molded, integral holder for coins as defined in claim 5, wherein;

(a) said latch member is integrally mounted on said one of said half-body portions at a longitudinal central position for releasable locking engagement with said lip fastener member; and, (b) said lip fastener member is integrally mounted on said other of said half-body portions at a longitudinal central position for releasable locking engagement with said latch member and said lip fastener member has an upper side which curves downwardly to meet a lower flat side with the upper curved side engaging the latch member during the movement of the half-body portions to a closed position to assist the latch member to slide over the lip fastener member and into locking engagement with the lower flat side thereof.

9. A molded, integral holder for coins as defined in claim 5, wherein:

(a) each of said plurality of geometric openings is made in the form of an oblong opening with rounded ends.

10. A molded, integral holder for coins as defined in claim 5, wherein;

(a) each of said geometric openings is triangularly shaped.

11. A molded, integral holder for coins as defined in claim 5, wherein:

(a) each of said geometric openings is rectangular in shape.

* * * * *